US006023917A

United States Patent [19]

Cardone

[11] Patent Number: 6,023,917

[45] Date of Patent: Feb. 15, 2000

[54] METHOD OF PRODUCING FINNED PACKAGES, AND A SEPARATING DEVICE FOR CARRYING OUT THE METHOD

[75] Inventor: Giovanni Cardone, Beringen, Switzerland

[73] Assignee: SIG Schweizerische Industrie–Gesellschaft, Rheinfall, Switzerland

[21] Appl. No.: 09/043,173

[22] PCT Filed: Sep. 19, 1996

[86] PCT No.: PCT/CH96/00324

§ 371 Date: Mar. 16, 1998

§ 102(e) Date: Mar. 16, 1998

[87] PCT Pub. No.: WO97/10996

PCT Pub. Date: Mar. 27, 1997

[30] Foreign Application Priority Data

Sep. 22, 1995 [CH] Switzerland ..... 2690/95

[51] Int. Cl.[7] ..... B65B 7/28

[52] U.S. Cl. ..... 53/487; 53/133.3; 53/133.6; 53/374.2; 53/389.3

[58] Field of Search ..... 53/487, 133.3, 53/133.6, 374.4, 374.2, 374.5, 389.3; 83/300, 337, 678

[56] References Cited

U.S. PATENT DOCUMENTS

| | | | |
|---|---|---|---|
| 3,943,686 | 3/1976 | Crawford et al. . | |
| 4,254,601 | 3/1981 | Prager et al. . | |
| 4,455,808 | 6/1984 | Netzhammer | 53/374.2 |
| 4,582,555 | 4/1986 | Bower | 53/374.2 |
| 4,949,846 | 8/1990 | Lakey . | |
| 5,477,656 | 12/1995 | Loewenthal | 53/374.4 |
| 5,564,263 | 10/1996 | Boulanger et al. | 53/374.2 |

FOREIGN PATENT DOCUMENTS

| | | |
|---|---|---|
| 0659645 | 6/1995 | European Pat. Off. . |
| 507786 | 7/1971 | Switzerland . |

*Primary Examiner*—Eugene L. Kim
*Attorney, Agent, or Firm*—Venable; George H. Spencer; Catherine M. Voorhees

[57] ABSTRACT

The method proposed calls for a crush blade (9), which separates cross-sealed plastic bags from each other, to be built into a cross-sealing jaw. The crush blade (9) has a zig-zag crush edge (16) made up of V-shaped grooves (17,18) laterally staggered with respect to each other. Joining with the angles (26,27) of the crush edge (16) are sharp cutting edges (24,25) which run in the direction of rotation (19) of the blade (9). The cutting edges (24,25) make an angle with the plane (23) of the crush edge (16). This ensures a long life of the blade (9) and makes it easy for the consumer to tear open the bags.

11 Claims, 2 Drawing Sheets

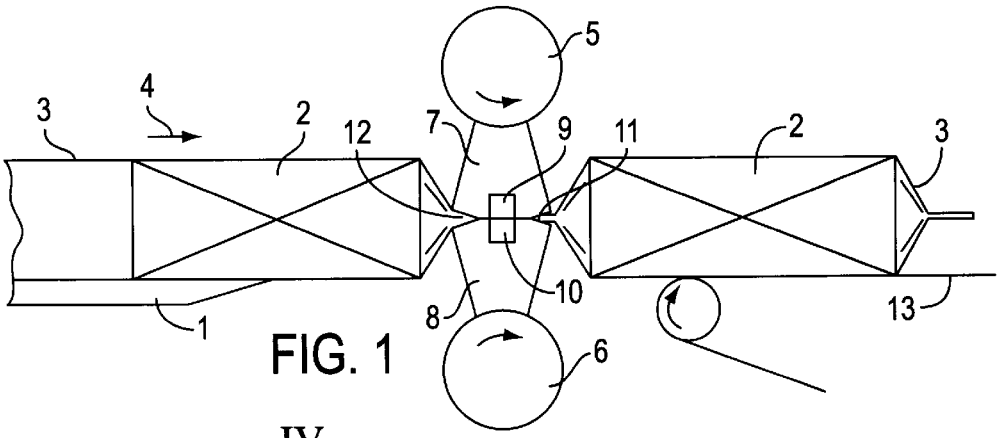
FIG. 1
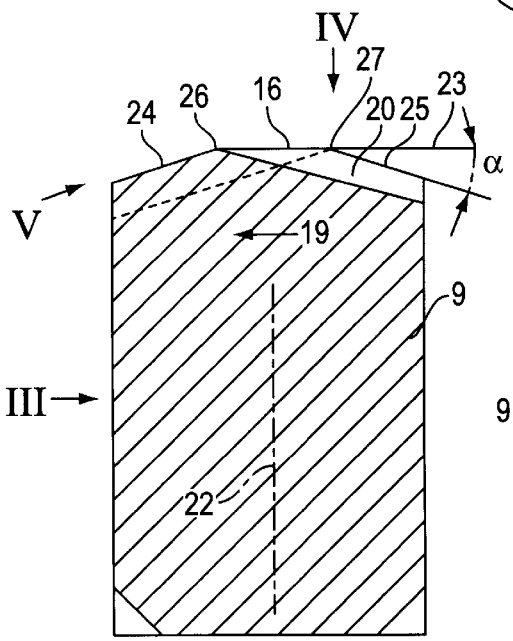
FIG. 2
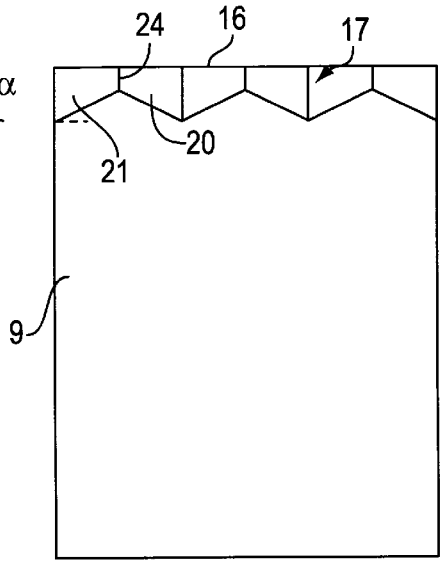
FIG. 3
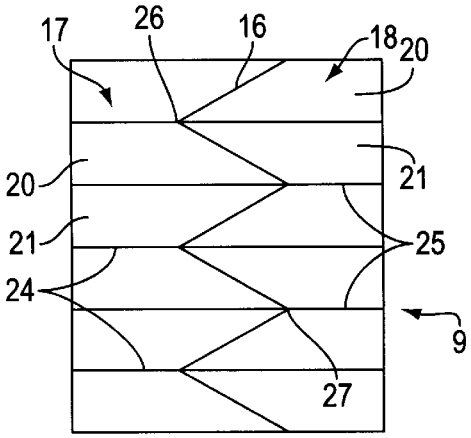
FIG. 4 ← 19
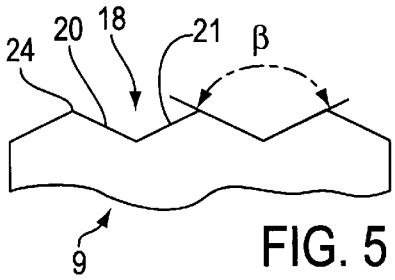
FIG. 5

METHOD OF PRODUCING FINNED PACKAGES, AND A SEPARATING DEVICE FOR CARRYING OUT THE METHOD

BACKGROUND OF THE INVENTION

The EP-A-659 645 discloses a method and a device for the cross-sealing and separating of a packaging tube. The device has two rotating cross-sealing jaws, which divide a foil tube into individual bags and at the same time separate the individual bags from each other with the aid of a zigzag blade. The blade is built into one of the sealing jaws, while the other jaw holds a counter support. The zigzag cut is designed to facilitate the tearing open. However, it has become apparent that only a very sharp blade will permit an easier tearing open by the consumer. The blade must be resharpened correspondingly often.

Another cross-sealing device with two sealing jaws moving in opposite direction is described in the U.S. Pat. No. 4,254,601. A saw-tooth shaped blade is inserted into one of the jaws, which blade separates the packages with a straight-line cut during the cross-sealing. In order to permit an easier tearing open of the packages, respectively one longitudinal slit is cut on both sides of the separating cut during the cross-sealing with respectively one additional blade adjacent to the cross-cutting blade and parallel to the tube conveying direction.

It is the object of the present invention to eliminate this disadvantage. This object is solved with the combination of features in the claims.

Exemplary embodiments of the invention are explained in the following with the aid of the drawing. Shown are in:

BRIEF DESCRIPTION OF THE DRAWING

FIG. 1 A diagrammatic view from the side of a cross-sealing device;

FIG. 2 A section through a crush blade;

FIGS. 3–5 Views in the direction of arrows III, IV and V in FIG. 2;

DETAILED DESCRIPTION OF THE INVENTION

Figure 6:
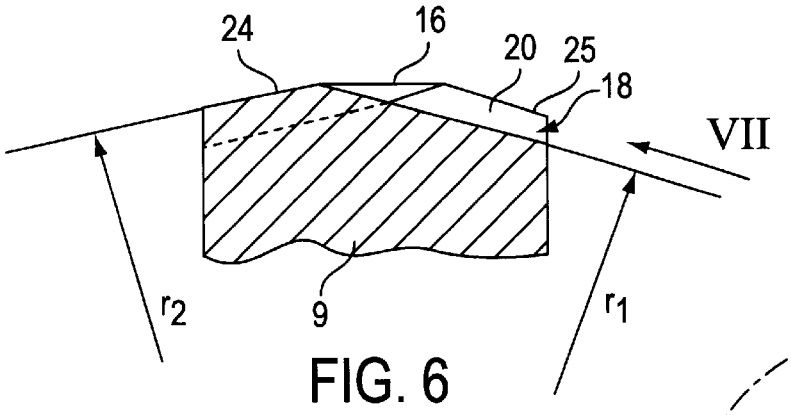
FIGS. 6 and 8 Sections through two other embodiments.

FIG. 1 shows a cross-sealing device for a packaging machine. A foil-type tube 3 formed with a longitudinal seam 1 contains at regular intervals the products 2 to be packaged and is transported in conveying direction 4. A sealing jaw 7 and a counter jaw 8 are mounted on two parallel shafts 5, 6, driven synchronously in opposite directions. The one jaw 7 holds a crush blade 9, the other one a counter support 10. The crush blade 9 cuts through the center of the cross-sealing seam, formed with the jaws 7, 8. During the rotational movement, the jaws 7, 8 seal the tube 3 initially at a first location 11. This is followed by the separating cut and subsequent cross sealing at a second location 12. The separated, finished package is removed with a conveyor belt 13.

FIGS. 2 to 5 show an enlarged illustration of the crush blade 9, having a zigzag-shaped crush edge 16, which is formed by the penetration of V-shaped grooves 17, 18. The forward grooves 17, in movement direction 19, are displaced relative to the lagging grooves 18 by one half the groove width. The sides 20, 21 of the grooves 17, 18 are level and are displaced on the side in a mirror symmetry to the center plane 22 of blade 9. The crush edge 16 thus forms a plane 23. Respectively two neighboring sides 20, 21 of adjacent grooves 17 or 18 form a forward cutting edge 24 or a lagging cutting edge 25. Each lagging cutting edge is offset from its adjacent cutting edge by a width of one groove. Forward corners 26 are formed at the intersection of forward cutting edges 24 and the crush edge 16. Lagging corners 27 are similarly formed at the intersection of lagging cutting edges 25 and the crush edge 16. The two sides 20, 21 of grooves 17, 18 form an obtuse angle $\beta$ of 95–150°, preferably about 120°, perpendicular to their cutting edges 24, 25 as seen in the cross section. The crush edge 16 does not have to be sharp-edged, but can be blunt with a width of 0.02–0.1 mm.

It has turned out that the serration by means of the sharp-edged cutting edges 24, 25, in particular with the forward cutting edge 24, makes it considerably easier to tear open the packages. An extraordinarily long service life is achieved, owing to the very obtuse angles of the crush edge 16 and because this edge does not need to be sharp. The described crush blade permits high rotational speeds for the shafts 5, 6 and thus also a high production speed.

Figure 7:
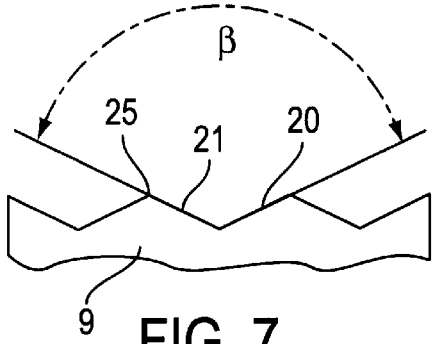
FIGS. 7 and 9 Views in the direction of arrows VII or IX in FIG. 6 or 8.

For the embodiment according to FIGS. 6 and 7, the grooves 17, 18 have a circular arc shape. The groove bottom therefore has a radius $r_1$ and the cutting edges 24, 25 have a radius $r_2$. The sides 20, 21 are truncated-cone segment surfaces. The advantage here is that the grooves 17, 18 can be produced very economically on a circular grinding machine.

Figure 8:
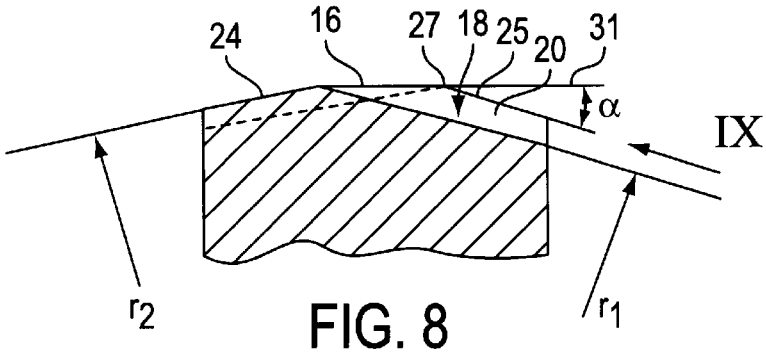
Figure 9:
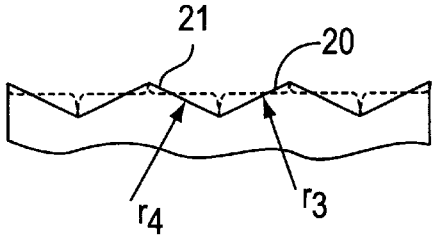

The embodiment according to FIGS. 8 and 9 is thus distinguished from the embodiment according to FIGS. 6 and 7 in that the sides 20, 21 have a convex shape with the radii $r_3$, $r_4$, according to the frontal view in FIG. 9, which radii are preferably substantially identical. Thus, the sides 20, 21 are torus-shaped. The advantage here is that the crush edge 16 is no longer positioned in a plane, but on a cylindrical surface that is preferably coaxial to the shaft 5. A uniform separating cut can be achieved as a result of this. The angle $\alpha$ is measured here relative to the tangent 31 on the cylindrical surface of crush edge 16, at the edge 27.

The sides 20, 21 can also consist of convex and straight sections, e.g. as indicated by the dashed lines in FIG. 9. The flattening of the crush edge 16 in this case can have a variable width inside the plane 23 or the cylindrical surface.

In order to create sharp-edged serrations 40 (FIG. 10) on the package 35, the cutting edges 24, 25 must be sharp-edged. This is achieved in that the sides 20, 21 that form one and the same cutting edge 24, 25 are ground one after another.

Figure 10:
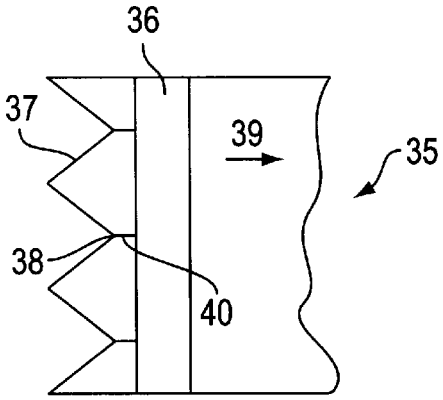
FIG. 10 A detail of a package.

FIG. 10 shows a section of a tube-shaped, finned package 35, produced with the above-described arrangement, and having a cross-sealing seam 36 and a zigzag-shaped cross-wise separating cut 37. Serrated cuts 40 extending in longitudinal direction 39 of the package 35 can originate from the concave, sharp corners 38 of the separating cut 37, which serrated cuts make it easy for the consumer to tear open the package.

I claim:

1. A separating device for a tube packaging machine comprising:

a sealing jaw mounted on a first rotatable shaft;

a counter jaw mounted on a second rotatable shaft said second rotatable shaft being rotatable in a direction opposite the direction of rotation of said first rotatable shaft;

a blunt crush blade held by said sealing jaw, said crush blade having a zigzag-shaped crush edge formed by a plurality of V-shaped grooves, said grooves having a plurality of alternating forward grooves and lagging grooves, said lagging grooves being displaced from said forward grooves by one half of a groove width, each said groove further having two sides said crush edge defining a surface;

a counter support held by said counter jaw;

a plurality of forward cutting edges each formed by a pair of neighboring forward grooves;

a plurality of lagging cutting edges each formed by a pair of neighboring lagging grooves, where each said lagging cutting edge is offset from its neighboring forward cutting edge by half a width of one groove, wherein each pair of adjacent sides of said grooves forms an obtuse angle of between 95 degrees and 150 degrees at the forward cutting edges and the lagging cutting edges;

a plurality of forward corners of said crush edge, each said forward corner formed at the intersection of one of said forward cutting edges and said crush edge, said forward cutting edges intersecting said surface at an angle of less than 50°; and a plurality of lagging cutting edges of said crush edge, each said lagging corner formed at the intersection of one of said lagging cutting edges and said crush edge, said lagging cutting edges intersecting said surface at an angle of less than 50°.

2. The separating device according to claim 1, wherein the respective angles enclosed by said forward cutting edges intersecting said surface and said lagging cutting edge intersecting said surface are substantially identical.

3. The separating device according to claim 1, wherein the respective angles enclosed by said forward cutting edges intersecting said plane and said lagging cutting edges intersecting said surface are approximately 20°.

4. The separating device according to claim 1, wherein each pair of adjacent sides of said grooves forms a truncated-cone segment surface.

5. The separating device according to claim 1, wherein each pair of adjacent sides of said grooves forms a convex, curve shaped cross section.

6. The separating device according to claim 4, wherein said sides have substantially identical radii.

7. The separating device according to claim 1, wherein said crush edge is blunt with a width of 0.02–0.1 mm.

8. A method of producing a finned package using the separating device of claim 1 comprising the steps of:

disposing a tube having a longitudinal sealing seam and products contained therein on a conveying means;

a first sealing of said tube crosswise during a rotational movement at a first location when said tube passes between a sealing jaw and a counter jaw;

making a separating cut crosswise in a zigzag shape by a blunt crush blade when said tube passes between a sealing jaw and a counter jaw; sharp-edged serrating the tube after the first sealing and prior to the separating cut; and a second sealing of said tube during a further rotational movement at a second location when said tube passes between a sealing jaw and a counter jaw.

9. The method according to claim 8, wherein a sharp-edged serrating of said tube occurs once more prior to the second crosswise sealing.

10. The method according to claim 8, comprising the additional step of making serrations originating from corners of said zigzag shaped separating cut.

11. A tube-shaped finned package, produced according to claim 8, with zigzag-shaped crosswise separating cuts adjacent to a cross-sealing seam, wherein sharp serrations originate from the concave corners of the separating cuts for the package.

* * * * *